US007596922B2

(12) United States Patent
Englekirk et al.

(10) Patent No.: US 7,596,922 B2
(45) Date of Patent: Oct. 6, 2009

(54) STRUCTURAL WALL COUPLING SYSTEM

(75) Inventors: Robert E. Englekirk, Carlsbad, CA (US); Afshin Ghodsi, Los Angeles, CA (US); Walter H. Mawby, Grand Prairie, TX (US)

(73) Assignees: Englekirk Partners Consulting Structural Engineers, Inc., Los Angeles, CA (US); Highrise Concrete Systems, Inc., Grand Prairie, TX (US)

( * ) Notice: Subject to any disclaimer, the term of this patent is extended or adjusted under 35 U.S.C. 154(b) by 540 days.

(21) Appl. No.: 10/685,048

(22) Filed: Oct. 14, 2003

(65) Prior Publication Data

US 2004/0083663 A1 May 6, 2004

Related U.S. Application Data

(60) Provisional application No. 60/417,780, filed on Oct. 11, 2002.

(51) Int. Cl.
*E04B 1/00* (2006.01)

(52) U.S. Cl. ..... 52/741.13; 52/745.1; 52/236.8; 52/236.9; 52/251; 52/79.9; 52/79.11; 52/167.3

(58) Field of Classification Search ..... 52/79.2, 52/79.8, 79.9, 79.11, 79.13, 167.1, 167.3, 52/741.13, 745.1, 236.8, 236.9, 251, 745.08, 52/236.7, 259, 439

See application file for complete search history.

(56) References Cited

U.S. PATENT DOCUMENTS 1,886,962 A * 11/1932 La Roche ..... 52/236.7
3,149,437 A * 9/1964 Wheeler-Nicholson ..... 52/439
3,254,466 A * 6/1966 Von Heidenstam ..... 52/745.13
3,372,519 A * 3/1968 Russell ..... 52/274
3,462,908 A * 8/1969 Wysocki ..... 52/745.02
3,775,928 A * 12/1973 Dawson et al. ..... 52/745.13
3,805,461 A * 4/1974 Jagoda ..... 52/79.11
3,979,919 A 9/1976 Blonde et al.
4,261,542 A 4/1981 Lefebvre
4,282,690 A * 8/1981 Meheen ..... 52/79.11

(Continued)

OTHER PUBLICATIONS

EDI Architecture, Inc., brochure entitled "Tunnelform," Dec. 10, 2000; 8 pgs.

(Continued)

*Primary Examiner*—Richard E Chilcot, Jr.
*Assistant Examiner*—Chi Q Nguyen
(74) *Attorney, Agent, or Firm*—Conley Rose, P.C.

(57) ABSTRACT

An apparatus and method for coupling separate series or stacks of structural or shear walls of a multistory building are disclosed. The method comprises constructing a plurality of stacks of shear walls and attaching a rigid coupling member to the top of at least two of the stacks of shear walls between the stacks such that the walls are connected to the rigid coupling member and move together with the coupling member. The apparatus is a rigid coupling member, which may be a beam, such as an I-beam or rectangular beam, made from poured concrete and reinforcing steel. The coupling member may also be a wall of poured concrete and reinforcing steel. The attached rigid member acts to connect the tops of independent stacks of shear walls typically used to build multistory buildings, thereby creating a flexural moment at the top of the building that helps the building resist lateral loads.

12 Claims, 4 Drawing Sheets

U.S. PATENT DOCUMENTS

| | | | | |
|---|---|---|---|---|
| 4,439,064 | A | 3/1984 | van der Gaarden | |
| 4,525,975 | A * | 7/1985 | McWethy | 52/745.03 |
| 4,735,028 | A * | 4/1988 | Bouchon et al. | 52/561 |
| 5,491,942 | A * | 2/1996 | Prokasky | 52/236.3 |
| 5,737,895 | A * | 4/1998 | Perrin | 52/745.1 |
| 5,867,964 | A * | 2/1999 | Perrin | 52/745.1 |
| 6,668,508 | B2 * | 12/2003 | Boone et al. | 52/645 |
| 6,935,077 | B2 * | 8/2005 | Wulfert et al. | 52/167.1 |

OTHER PUBLICATIONS

Englekirk Partners job proposal to City of Long Beach, entitled "Design Basis and Methodology for the Shear Walls—Ocean Villas," Aug. 8, 2001, 55 pgs.

Taylor, et al., "Design of Slender Reinforced Concrete Walls with Openings," ACI Structural Journal/Jul.-Aug. 1998, pp. 420-433.

Zhang et al., "Seismic Behavior of Reinforced Concrete Shear Walls Subjected to High Axial Loading," ACI Structural Journal/Sep.-Oct. 2000, pp. 739-750.

* cited by examiner

STRUCTURAL WALL COUPLING SYSTEM

CROSS-REFERENCE TO RELATED APPLICATIONS

The present application claims the benefit of U.S. Provisional Application Ser. No. 60/417,780 filed Oct. 11, 2002, entitled Structural Wall Coupling System, which is hereby incorporated herein by reference.

STATEMENT REGARDING FEDERALLY SPONSORED RESEARCH OR DEVELOPMENT

Not applicable.

BACKGROUND OF THE INVENTION

1. Field of the Invention

The present invention relates to the process of constructing a building using shear walls, poured-in-place concrete tunnel forms, and other similar construction methods. More specifically, the present invention relates to beneficially distributing the seismic actions in a building constructed with stacks of shear walls or tunnel forms by coupling the shear walls at the top of the building.

2. Background and Related Art

In the construction of large residential complexes, high-rise buildings, and other multistory buildings, it is important to consider the axial, shear, and flexural forces exerted on the buildings. Axial forces are those acting parallel to the longitudinal axes of the buildings, and are typically caused by the weight of the building materials and the weight of the contents of the building. Shear forces and flexural moments act substantially perpendicular to the longitudinal axes of the buildings, and may be caused by winds or seismic activity. Because buildings act like vertical cantilever beams, the shear forces exerted on the buildings create potentially harmful bending moments and flexural demands. Thus, structural walls, beams, and other reinforcing members must be able to withstand not only axial loads but also lateral loads and the shear forces and flexural demands they create.

Shear walls are well known in the art for withstanding significant lateral loads. Shear walls may be made from a variety of building materials known by those skilled in the art. Generally, shear wall materials include fibers which resist relative movement, i.e., fibers which resist movement relative to surrounding fibers. Often, shear walls used in multistory buildings are made from poured concrete with reinforcing steel, also known as rebar.

Multistory buildings act as cantilever beams such that when lateral loads are applied to the building, the flexural resistance is greatest at the base of the building and decreases generally linearly toward the top of the building. Thus, it is often necessary to increase the thickness of the shear walls at the base of a multistory building, as well as increase the amount of reinforcing, to compensate for the increased forces and moments at the base. However, it is very desirable to maintain thin shear walls and limit the amount of reinforcing in shear walls. Thin shear walls and reduced reinforcing decreases costs and increases the speed of construction. Thinner walls with less reinforcing also increases the ductility of the walls, which leads to a reduced likelihood of distress in the building.

The advent of poured-in-place concrete tunnel construction methods has increased the cost-effectiveness and strength of multistory concrete buildings. The process of constructing a building using poured-in-place concrete tunnel construction methods is also typically called "tunnel forming" or "tunnel framing." Construction of buildings using tunnel forming has been utilized for many years in the construction of multistory concrete buildings. Tunnel forming allows the walls and floor of a certain level of the building to be poured simultaneously. This method greatly reduces the costs associated with multistory concrete construction. There are many structures used in the tunnel forming process, such as those that are described in U.S. Pat. Nos. 4,439,064, 4,261,542, and 3,979,919, each of which is incorporated herein by reference.

However, even with tunnel forming, bottom-heavy flexural forces pose a problem. With typical shear wall structures, lateral loads from any direction cause undesired shear forces and flexural demands. With tunnel forming, shear forces acting parallel with the direction of the longitudinal axes of the horizontal concrete tunnels are slightly less problematic than shear forces acting perpendicular to these axes. Thus, even though tunnel forming partially reduces the problem with shear forces and flexural demands, it does not completely eliminate the problem. Consequently, conventional shear wall structures, tunnel form structures, as well as other building structures are susceptible to shear forces in any direction, thereby necessitating increased flexural resistance in such buildings without the use of thicker structural or shear walls, or increased reinforcing.

The present invention overcomes the deficiencies of the prior art.

BRIEF SUMMARY OF SOME OF THE PREFERRED EMBODIMENTS

The embodiments described herein provide an apparatus and method for coupling multiple portions of structural walls of a multistory building such that the building will resist lateral loads caused by seismic actions, for example. In one embodiment, the apparatus is a structure comprising a first portion of stacked shear walls having a top end that is moveable between an unloaded position and a loaded position, and a bottom end that is substantially fixed; a second portion of stacked shear walls having a top end that is moveable between an unloaded position and a loaded position, and a bottom end that is substantially fixed; and a rigid member connecting the first top end to the second top end, wherein the rigid member couples the top ends in the unloaded and loaded positions.

In another embodiment, the apparatus is a structure comprising a first stack of poured-in-place concrete tunnels with each tunnel having a first longitudinal axis, and two vertical portions and a horizontal portion, wherein the first stack has a bottom row of tunnels and a top row of tunnels; a second stack of poured-in-place concrete tunnels adjacent the first stack with each tunnel having a second longitudinal axis, and two vertical portions and a horizontal portion, wherein the second stack has a bottom row of tunnels and a top row of tunnels; a rigid member that connects the first top row to the second top row; and wherein the first longitudinal axis is parallel to the second longitudinal axis. In yet another embodiment, the first longitudinal axis is perpendicular to the second longitudinal axis.

In a further embodiment, the apparatus is a multi-story building for resisting seismic actions, the building comprising a first stack of shear walls moveable between an unloaded position and a loaded position; a second stack of shear walls adjacent the first stack, the second stack moveable between an unloaded and loaded position; and a stiff, rigid member attached to the first and second stacks such that the first and second stacks are coupled, and move together substantially simultaneously and coincidentally between the unloaded and loaded positions In the various embodiments, the coupling apparatus is a coupling member that may be a rectangular or I-shaped beam made of various materials, such as poured concrete and rebar, steel or industrial plastic. Alternatively, the coupling member may be a wall of poured concrete and reinforcing steel, as well as other forms as will be described herein. The coupling member is preferably attached adjacent to the tops of at least two stacks of shear walls or tunnel forms, thereby coupling the separate stacks of shear walls significantly more robustly than other means, such as corridor walls, floors and other incidental structures.

In one embodiment, the method comprises coupling separate portions of a multistory building by constructing a first series of stacked shear walls having a top end and a bottom end; constructing a second series of stacked shear walls adjacent the first series, the second series of shear walls having a top end and a bottom end; attaching a rigid member to the first and second series of shear walls; and connecting the first and second series with the rigid member such that when the first and second series move in response to a lateral load, the first series moves substantially simultaneously and coincidentally with the second series. In another embodiment, the rigid member is attached adjacent the top ends of the series of shear walls.

Thus, the building, as coupled by the rigid member, is converted from a cantilevered beam to a vertical truss, thereby distributing the shear and flexural forces due to lateral loads in such a way so as to resist seismic and other such actions without increasing the thickness of the shear walls or the amount of reinforcing used in the shear walls.

The features and characteristics mentioned above, and others, provided by the various embodiments of this invention will be readily apparent to those skilled in the art upon reading the following detailed description of preferred embodiments, and by referring to the accompanying drawings.

BRIEF DESCRIPTION OF THE DRAWINGS

For a detailed description of some of the preferred embodiments of the invention, reference will now be made to the accompanying drawings wherein.

NOTATION AND NOMENCLATURE

In the following discussion and in the claims, the terms "including" and "comprising" are used in an open-ended fashion, and thus are to be interpreted to mean "including, but not limited to . . . ". When referring to loads and forces, the term "axial" is intended to mean those forces or loads acting substantially perpendicular or vertical to the earth's surface. The term "lateral" is used to refer to forces or loads acting substantially parallel or horizontal to the earth's surface. The term "shear forces" refers to those forces created within a building's structure as a result of an applied lateral load. The terms "flexural forces," "flexural moments," "flexural resistance" and "flexural demands" relate to the bending moments created within a building as a result of an applied lateral load.

This exemplary disclosure is provided with the understanding that it is to be considered an exemplification of the principles of the invention, and is not intended to limit the invention to that illustrated and described herein. In particular, various embodiments of the present invention provide a number of different constructions and methods of operation. It is to be fully recognized that the different teachings of the embodiments discussed below may be employed separately or in any suitable combination to produce desired results.

DETAILED DESCRIPTION OF THE PREFERRED EMBODIMENTS

Figure 1:
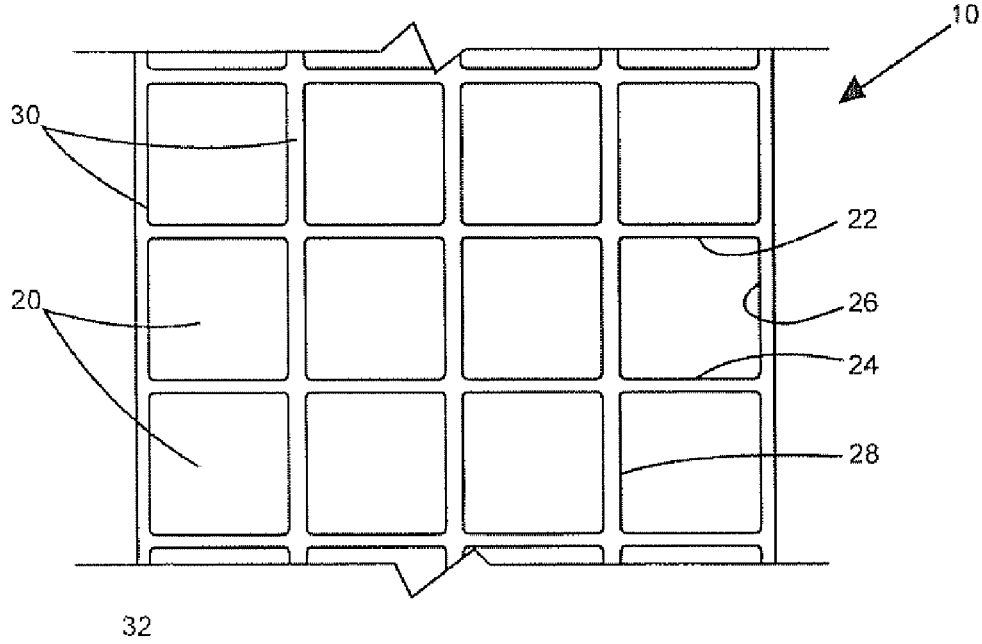
FIG. 1 is a partial cross-sectional view of a building constructed using poured-in-place concrete tunnel construction methods.
Figure 2:
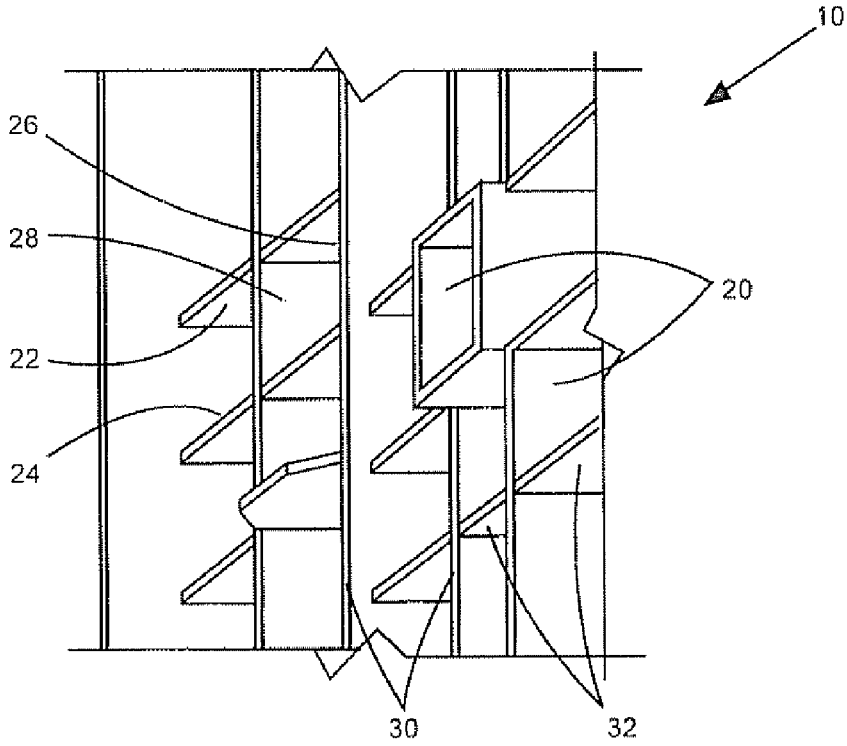
FIG. 2 is perspective view of a partially constructed building using poured-in-place concrete tunnel construction methods.

A number of embodiments of a structural wall coupling system for multistory buildings according to the present invention will now be described with reference to the accompanying drawings. Referring first to FIGS. 1 and 2, partial views of a building constructed using the poured-in-place concrete tunnel construction method are shown. In FIGS. 1 and 2, building 10 includes tunnels 20 having top wall 22, bottom wall 24, and sides 26, 28. The walls 22, 24 of tunnels 20 form floors 32 and sides 26, 28 form shear walls 30.

Figure 3A:
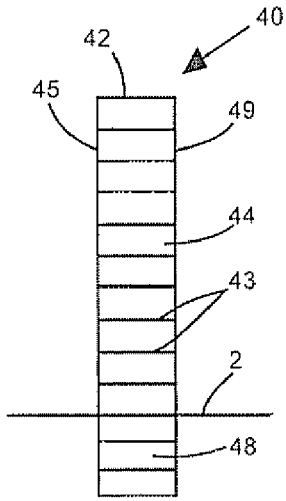
Fig.3A (Prior Art)
FIG. 3A is a cross-sectional view of a multistory building, the cross section being taken along the plane of a single shear wall of the building.
Figure 3B:
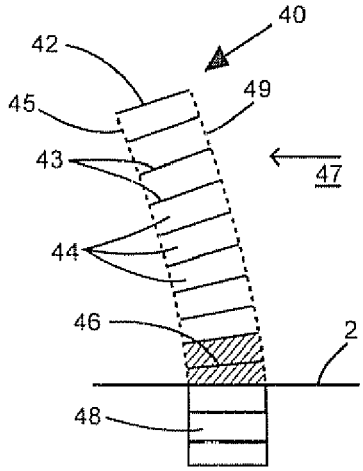
Fig.3B (Prior Art)
FIG. 3B is a cross-sectional, exaggerated view of the multistory building of FIG. 3A been deflected in response to a lateral load.

Referring now to FIGS. 3A and B, a conventional multistory building 40 is shown in cross-section having outer walls 45, 49, shear walls 44, floors 43, roof 42, and stiff foundation portion 48 extending into ground 2. Shear walls 44 share a common plane, which is the same plane along which the cross-section for FIGS. 3A and B is taken. FIG. 3A shows building 40 in a normal, or unloaded, position without any deflection due to a lateral load. FIG. 3B shows building 40 in an exaggerated deflected, or loaded, position due to lateral load 47, which may be caused by winds, seismic activity, or any other phenomenon causing a lateral load to be exerted on building 40. However, it should be understood that lateral loads having the magnitude to deflect building 40, as does lateral load 47, are typically caused by seismic activity. Thus, for simplicity, lateral load 47 and other lateral loads hereinafter described will be caused by seismic activities, such as earthquakes. The flexural forces produced in building 40 by lateral load 47 will be greatest near base portion 46 of building 40. Base portion 46 is also where plastic hinging of shear walls 44, and any other shear walls substantially parallel to walls 44, of building 40 will occur. The deflection of building 40 in FIG. 3B is exaggerated to more fully show the curvature and hinging of building 40 in response to lateral load 47.

Figure 3C:
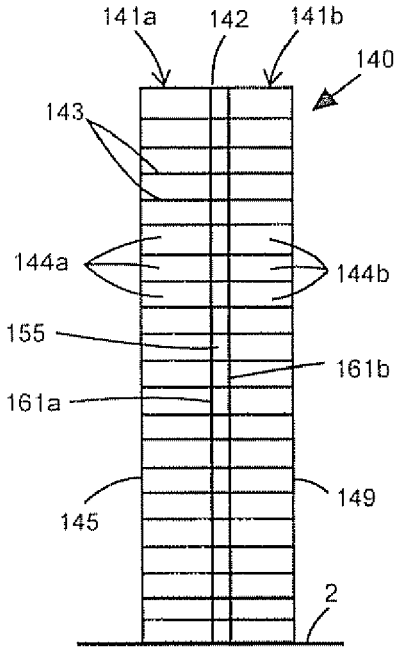
Fig.3C (Prior Art)
FIG. 3C is a cross-sectional view of a multistory building having two vertical structural portions separated by a corridor, the cross section being taken along the plane of a single shear wall of the building.

Referring now to FIG. 3C, an alternative embodiment to building 40 is shown. Conventional building 140 comprises a first structural portion 141*a* and a second structural portion 141*b*. Structural portions 141*a, b* may also be thought of as stacks or columns of shear walls 144*a, b* and floors 143. Columns 141*a, b* are separated by a corridor or shaft 155. Column 141*a* includes an outer wall 145 and an inner wall 161*a*, which also serves to separate shear walls 144*a* from corridor 155. Column 141*b* includes an outer wall 149 and an inner wall 161*b*, which also serves to separate shear walls 144*b* from corridor 155. Generally, outer walls 145, 149 and inner walls 161*a, b* are perpendicular to shear walls 144*a, b*. At the top of building 140 is roof 142. Below roof 142, floors 143 separate building 140 into residential or office units. Typically floors 143 extend from outer wall 145 to outer wall 149; however, shear walls 144*a* are separated from shear walls 144*b* by corridor 155, thereby forming separate units or rooms arranged in columns 141*a, b*.

Figure 3D:
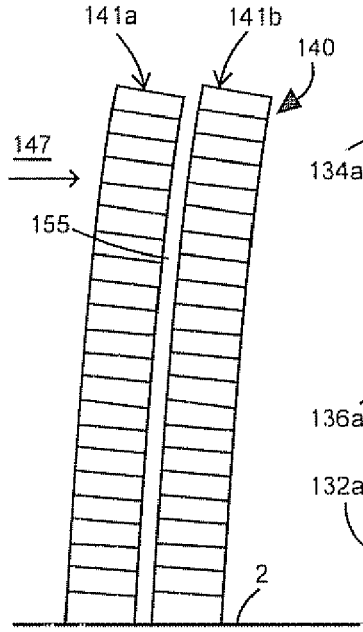
Fig.3D (Prior Art)
FIG. 3D is a cross-sectional view of the multistory building of FIG. 3C having been deflected in response to a lateral load.

The structure of building 140 is typical of many modern day, multistory or high-rise residential and office buildings. The simple and relatively uniform design reduces the costs and time associated with constructing such buildings. Furthermore, the proliferation of tunnel forming as a means of constructing such buildings dictates that many of these buildings will include stacks of tunnels, such as those seen in FIGS. 1 and 2, that may be walled off at certain intervals to create individual residential or office unites. Multiple stacks of units, such as stacks 141*a, b*, may be lined up with adjacent stacks having a corridor, such as corridor 155, separating each stack. The corridor provides hallways on each floor for inside access to the individual residential or office units. The corridor may also include elevator shafts. Typical structures associating the separate, adjacent stacks of shear walls or tunnel forms include exterior walls of building 140, floors, such as floors 143, and a roof, such as roof 142. However, these associating structures are intended to consolidate stacks 141*a, b* into functional buildings, and do not provide a rigid coupling means between stacks 141*a, b*. Therefore, these structure are only incidental in resisting significant lateral loads applied to building 140. As can be seen in FIG. 3D, any associating structures present in corridor 155 are destroyed as a result of the forces caused by lateral load 147, and fail to couple stacks 141*a* and *b*. Thus, stacks 141*a* and *b* act as independent cantilevered beams when subjected to a lateral load.

Referring next to FIG. 3D, building 140 is shown in a deflected, or loaded, position in response to lateral load 147. The deflection of building 140 is similar to that of building 40 shown in FIG. 3B. However, building 140 comprises dual columns 141*a, b* instead of a single column as in building 40. Because corridor 155 separates columns 141*a, b*, columns 141*a, b* may react independently of each other in response to external loads. As shown in FIG. 3D, lateral load 147 has caused both columns 141*a, b* to deflect in a similar manner. However, during an earthquake, for example, lateral loads may be applied to building 140 in multiple directions within a short period of time. Consequently, it is possible for columns 141*a, b* to deflect in opposite directions, thereby causing building 140 to split along corridor 155. In any case, the flexural forces and moments exerted on building 140 by lateral load 147 may be large and detrimental.

Figure 3E:
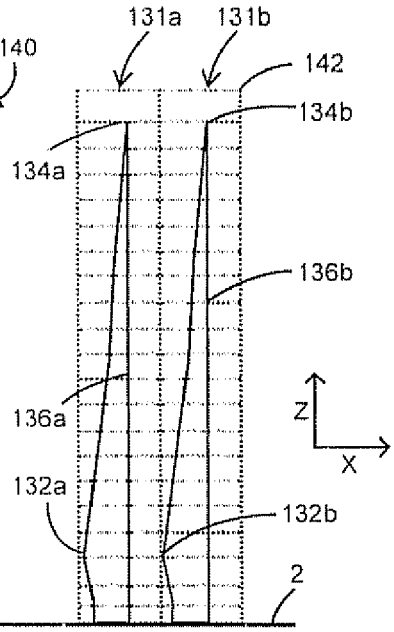
Fig.3E (Prior Art)
FIG. 3E is a flexural moment diagram corresponding to FIG. 3D.

Referring now to FIG. 3E, the flexural forces experienced by building 140 due to lateral load 147 are expressed as flexural moment diagrams 131*a, b*. Diagram 131*a* corresponds to column 141*a* and diagram 131*b* corresponds to column 141*b*. Values along the Z axis represent the distance along building 140 starting from ground 2 and increasing up to top 142. Values along the X axis represent the magnitude of the flexural moment at the corresponding location along building 140. Central axes 136*a, b* represent zero flexural moments for columns 141*a, b*, respectively. It can be seen that the flexural moments in building 140 subjected to lateral load 147 are greatest near the base of building 140, and more specifically at points 132*a, b* on diagrams 131*a, b*. The flexural moments gradually decrease along building 140 until they approach zero at points 134*a, b* near top 142 of building 140.

Figure 4A:
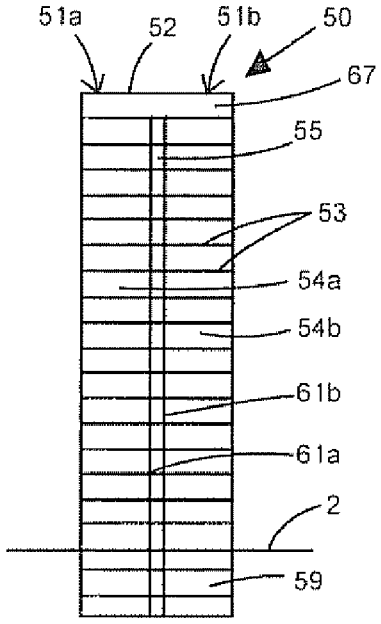
FIG. 4A is a cross-sectional view of a multistory building having two vertical structural portions separated by a corridor and a coupling beam attached to the top, the cross section being taken along the plane of a single shear wall of the building.

In FIGS. 4A-D, building 50 is shown as one embodiment in accordance with the principles of the present invention. Referring first to FIG. 4A, multistory building 50 is shown having a first structural portion 51*a* with shear walls 54*a* and a second structural portion 51*b* with shear walls 54*b*. Structural portions 51*a, b* may also be thought of as stacks or columns of shear walls 54*a, b*. Building 50 also includes corridor 55 having side walls 61*a, b*, floors 53, roof 52 including coupling beam 67, and stiff foundation portion 59 extending into ground 2. FIG. 4A shows building 50 in a normal, or unloaded, position. The significant difference between building 50 of FIG. 4A and building 140 of FIG. 3C is the addition of cap beam 67 at the top of building 50.

Cap beam 67 serves to bridge the structural gap, such as corridor 55, between two major structural portions of a building, such as stacks 51*a, b* of building 50. Cap beam 67 is a rigid member that is securely coupled to both stacks 51*a, b*. Cap beam 67 may take many forms, and may be used in buildings with various configurations. For example, several different embodiments of cap beam 67 may be seen in FIG. 5, which will be described more fully hereinafter.

Figure 4B:
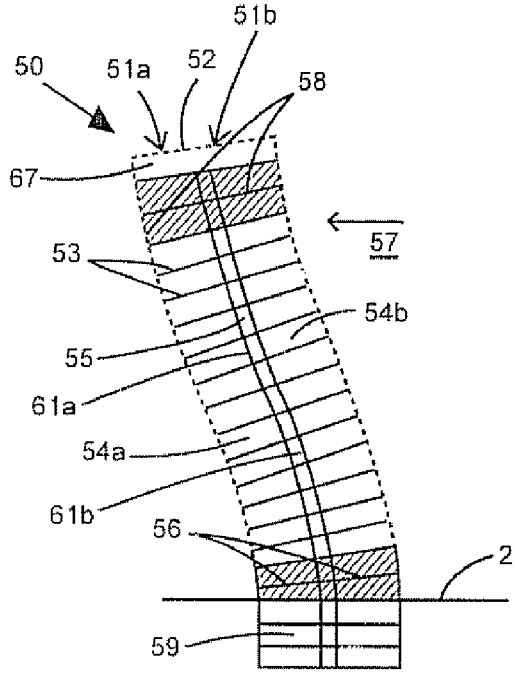
FIG. 4B is a cross-sectional, exaggerated view of the multistory building of FIG. 4A been deflected in response to a lateral load.

Comparing FIGS. 4A and B, building 50 is shown in FIG. 4A in an unloaded position without any deflection due to a lateral load, while FIG. 4B shows building 50 in an exaggerated loaded position due to lateral load 57. The curvature shown in FIG. 4B is exaggerated slightly for clarity. Building 50 exhibits a different curvature or deflection pattern than does building 40 of FIG. 3B. Cap beam 67 causes building 50 to bend in double curvature, where portions 51*a* and *b* bend simultaneously and coincidentally because cap beam 67 keeps their top portions coupled together. Thus, plastic hinging occurs not only at base portion 56, as with base portion 46 of building 40, but also at top portion 58 of building 50. Instead of acting like a cantilever beam, as does building 40, building 50 acts more like a vertical truss in response to lateral load 57, thereby distributing the flexural forces created by lateral load 57 more evenly over the entire length of building 50. Compared to building 40, some of the flexural forces exerted on building 50 have been transferred toward the top portion 58, thereby relieving some of the stresses experienced at base portion 46 of building 40. In one embodiment, the greatest flexural force will occur at two points along the length of building 50: at or near base portion 56 and at or near top portion 58. Preferably, these two flexural forces will be approximately equal, and substantially less than the greatest flexural force occurring in building 40 of FIG. 3B.

Figure 4C:
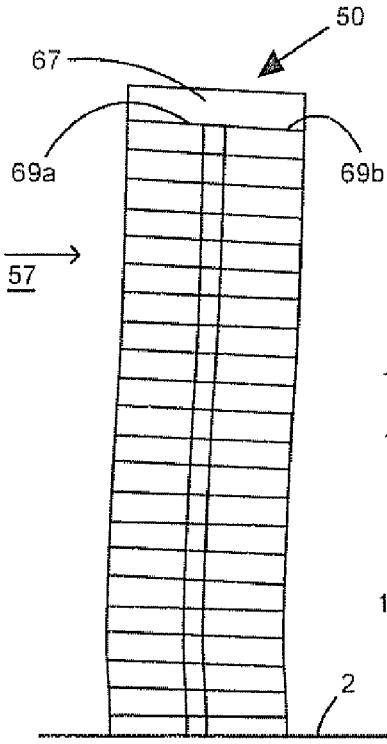
FIG. 4C is a cross-sectional view of the multistory building of FIG. 4A having been deflected in response to a lateral load.
Figure 4D:
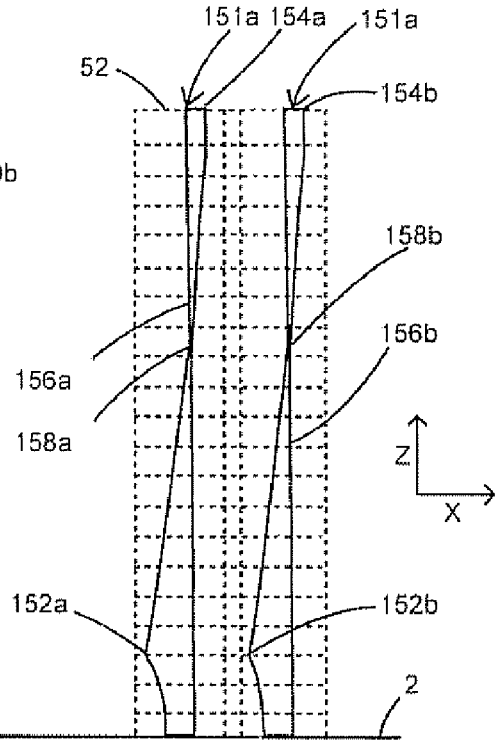
FIG. 4D is a flexural moment diagram corresponding to FIG. 4C.

To illustrate the previously described flexural force distribution in building 50, reference should now be made to FIGS. 4C and D. FIG. 4C shows building 50 having cap beam or wall 67, and being subjected to lateral load 57. As mentioned hereinbefore, lateral load 57 may be applied to building 50 in either of the directions shown in FIGS. 4B and C, and have the same effect in either case. Due to the coupling effect of cap beam 67, the flexural moments in building 50 will now be distributed as seen in FIG. 4D. As opposed to FIG. 3E, which illustrates a flexural moment diagram similar to that of a cantilever, FIG. 4D shows a flexural moment diagram similar to that of a truss. As in FIG. 3E, values along the Z axis represent positions along building 50 while values along the X axis represent the magnitude of the flexural moment at the corresponding location along building 140. Central axes 156*a, b* mark the zero flexural moment values for each of columns 151*a, b*, respectively, along the X axis. FIG. 4D shows that some of the flexural forces of FIG. 3E have been shifted toward the top 52 of columns 151*a, b*. Moreover, the flexural forces above central points 158*a, b* act in an opposite direction than the forces below central points 158*a, b*. Lower flexural moment peaks 152*a, b* occur in similar locations to moments 132*a, b* of FIG. 3E, although the magnitude of moments 152*a, b* are significantly reduced from the magnitude of peaks 132*a, b*.

As shown in FIG. 4D, there are now two peaks 152*a*, 154*a* and 152*b*, 154*b* on each flexural moment diagram 151*a, b*, respectively, as opposed to one peak on each diagram 131*a, b* in FIG. 3E. Peaks 152*a, b* are shown slightly greater than peaks 154*a, b*, although it should be understood that peaks 154*a, b* may be equal to or greater than peaks 152*a, b*. Also, zero-magnitude points 158*a, b* are shown closer to top 52 of building 50 than to ground 2, although points 158*a, b* may occur anywhere along central axes 151*a, b*, respectively.

Figure 5:
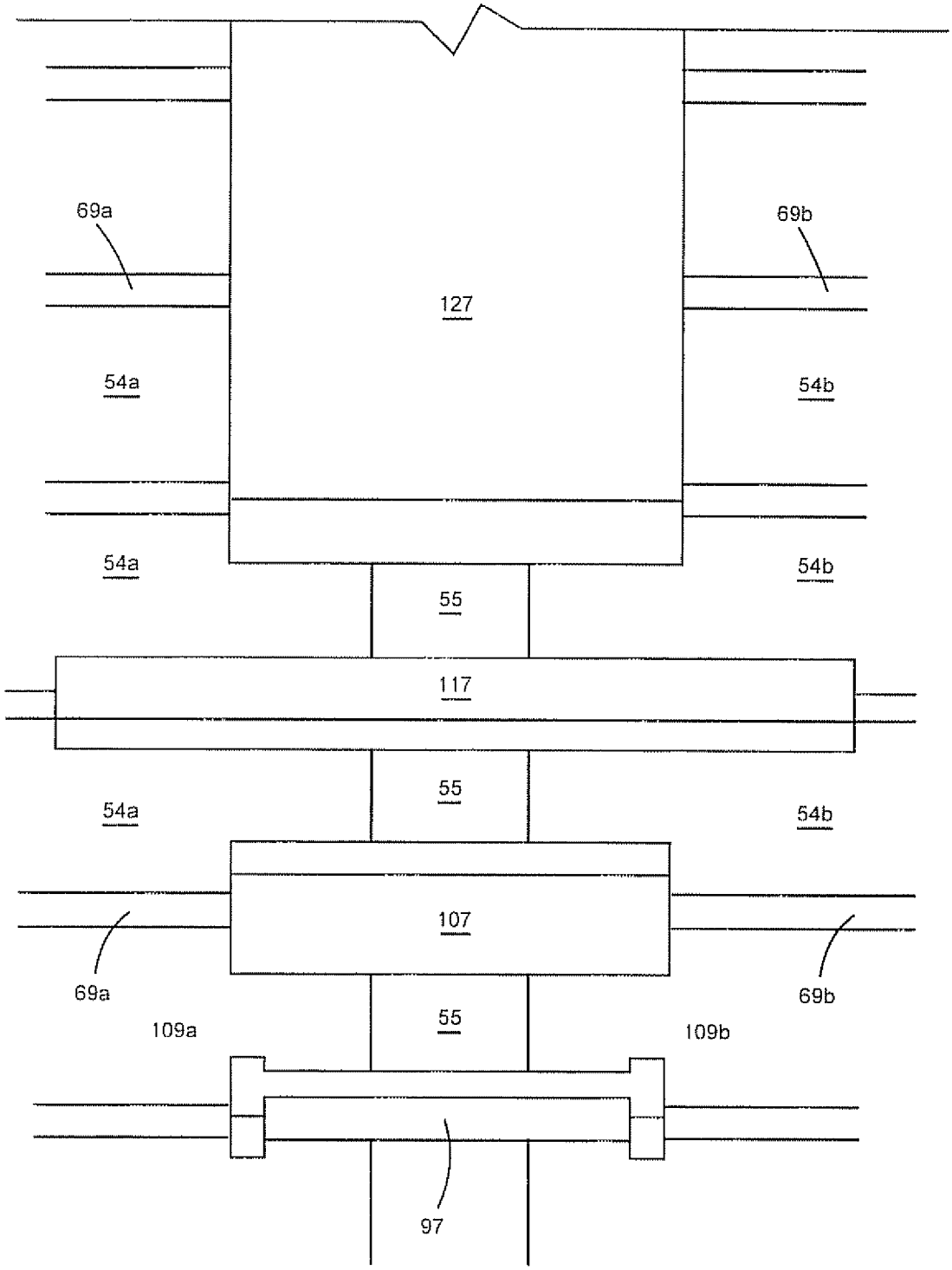
FIG. 5 is a top-down perspective view of a series of shear walls having alternative embodiments of the coupling beam attached to the top portions of the shear walls.

Referring now to FIG. 5, several embodiments of coupling beam 67 are shown. A series of shear walls 54*a, b* terminating with tops 69*a, b* are shown from a top, perspective view. The top ends 69*a, b* can also be seen in FIG. 4C. The several embodiments of cap beam 67 in FIG. 5 are shown on the same series of shear walls for simplicity, although typically one embodiment will be used in a single building. However, it should be understood that multiple embodiments of cap beam 67 may be used to couple a series of shear walls within a single building.

A first embodiment of cap beam 67 is shown as I-beam 97. Beam 97 is affixed to the tops 69*a, b* of a set of shear walls 54*a, b*, and spans corridor 55 so as to couple shear wall 54*a* with wall 54*b*. Next, rectangular beams 107, 117 are shown, positioned similarly to beam 97. Beams 107, 117 illustrate that cap beam 67 may have various dimensions. Beam 107 also shows that the beam may be set within recesses 109*a, b* of shear walls 54*a, b*, respectively. Finally, cap beam 67 may be poured as a continuous wall 127. Wall 127 may be attached to tops 69*a, b* or fixed within recesses 109*a, b* of shear walls 54*a, b*. Wall 127 may also extend over the entire lengths of shear walls 54*a, b*. It should be appreciated that the several embodiments of cap beam 67 in FIG. 5 are shown as examples and are not intended to be limiting.

In the embodiments shown in FIG. 5, the beams may be made from poured concrete having reinforced steel, or rebar, or any other suitable material known in the art. Thus, for example, beam 107 may be an eleven-foot deep, six-inch thick rectangular shaped concrete cap beam which couples shear walls 54*a, b*. When a lateral load is applied in the X direction of FIG. 4D, building 50 will exhibit the behavior previously described and shown with reference to FIGS. 4B-D.

Although the coupling member has been shown and described in various ways, the shape and makeup of the beam are constrained by the stiffness required to provide the coupling effect which causes the building to have a second location of plastic hinging, and by space limitations above the shear walls. To ensure proper stiffness, the coupling member may be made of concrete, steel or industrial plastic, or any other material used in the field to form stiff members. The coupling member may also include reinforcing, such as rebar or steel fibers, or other materials commonly used in the field for reinforcing. Coupling member 67 must have the physical integrity to withstand the forces that cause stacks 141*a, b* to bend independently, as seen in FIG. 3, sometimes causing stacks 141*a, b* to split. Coupling member 67 must also be able to counteract the flexural moments that have been transferred to the top of building 50, as seen in FIG. 4D. Lastly, the stiffness of coupling member 67 must be equal to or greater than the stiffness of the structural materials surrounding coupling member 67 so that member 67 does not fracture or fatigue before the surrounding structures. Thus, the importance of the present invention becomes apparent when it is realized that the other structures that typically associate one stack of shear walls or tunnel forms in a multistory building with another stack are not sufficiently robust or rigid. These associating structures do not couple the stacks such that they act as a vertical truss and withstand significant lateral loads.

Placement of the beam or coupling member is at or near the roof level of the building. Thus, the partially completed structure has reached the roof level before the coupling member can be poured or attached, which typically occurs at about 80% completion of the building. When the coupling member is poured or attached, it is preferred that the coupling member be securely attached to the shear wall or tunnel form it is intended to be attached to, which may include extending the reinforcing steel or rebar present in the shear wall or tunnel form into the coupling member. As mentioned above, space limitations between the shear walls and the roof of the building may constrain the potential shapes of the coupling beam. For example, if space between the roof and the shear walls is limited, beam 117 of FIG. 5 may be used. Or, if such space is even more limited, corridor walls 61*a, b* of FIG. 4A may simply come together near the top of building 50 and become a solid wall where the corridor no longer exists, with such an embodiment looking similar to wall 127 of FIG. 5.

As mentioned previously, cap beam 67 may be used in buildings having a variety of configurations. For example, a coupling beam may be used in building 40 of FIGS. 3A, B even though the configuration of building 40 does not consist of distinct stacks of shear walls as seen in building 140 of FIG. 3C. In the case of building 40, the coupling beam may be affixed to the tops of two or more selected inner shear walls like shear wall 44 such that the coupling member is coincident with the plane of the shear walls; or, the coupling member may span the entire width or depth of building 40 such that the coupling beam attaches to numerous shear walls of building 40, preferably where the coupling beam is coincident with the plane of the shear walls. Also, the coupling members may be used on multiple levels of the building. If a coupling beam is attached to building 40, building 40 will then exhibit behavior similar to the double curvature, double hinging behavior seen in FIG. 4B, although less pronounced because of the lack of a corridor such as corridor 55. However, such use of the present coupling system invention allows construction of the building to be completed with thinner shear walls, thereby decreasing costs and construction time, and increasing the ductility of the walls.

In an alternative embodiment, a coupling member or members are applied to a building constructed using poured-in-place concrete tunnel construction methods. Buildings such as buildings 40, 140, and 50 may be constructed using the tunnel forming technique seen in FIGS. 1 and 2. Referring to FIGS. 1 and 2, if tunnels 20 are aligned perpendicular to the direction they are shown in FIG. 1, then shear walls 30 would be represented by shear walls 44, 144*a, b*, and 54*a, b* of buildings 40, 140, and 50, respectively, and the embodiment here would be similar to the embodiments of FIGS. 3 and 4 with the added benefit of cost reduction provided by the use of tunnel forming. However, the use of certain arrangements of tunnel form provides additional benefits when used in conjunction with the coupling system of the present invention.

For example, building 50 may be built using the tunnel form technique, in which case the cross section of building 50 of FIGS. 4A-C and the corresponding description will not change substantially. However, stack 51*a* of building 50 may be a first series or stack of tunnels 20 aligned in one direction while stack 51*b* is aligned perpendicularly to stack 51*a*. Additional stacks may also be alternately aligned. When each stack is completed, the tops of shear walls 30 of each stack may be coupled to each adjacent stack as described hereinbefore. This will create a series of alternately aligned stacked tunnels which are coupled by cap beam 67 to form a building such as building 50.

The above discussion is meant to be illustrative of the principles and various embodiments of the present invention. Many variations and modifications of the invention and apparatus and methods disclosed herein are possible and are within the scope of the invention. Accordingly, the scope of protection is not limited by the description set out above, but is only limited by the claims which follow, that scope including all equivalents of the subject matter of the claims.

What is claimed is:

1. A method of coupling portions of a multistory building and resisting catastrophic shear forces therein, the method comprising:

constructing a first series of stacked shear walls, said first series of shear walls having a top end and a bottom end;

constructing a second series of stacked shear walls adjacent said first series, said second series of shear walls having a top end and a bottom end;

attaching a rigid member adjacent said top ends of said first and second series of shear walls;

moving each of said top ends from a first position to a second position;

connecting said top ends with said rigid member in said second positions such that said top ends do not move relative to each other;

resisting the catastrophic shear forces with said rigid member;

maintaining the connection between said first and second series during movement in response to the catastrophic shear forces; and returning said top ends to said first positions.

2. The method of claim 1 wherein:

said rigid beam comprises poured concrete and reinforcing steel, said rigid beam adapted to couple a shear wall in said first series to a spaced-apart shear wall in said second series at said top ends.

3. The method of claim 1 wherein said rigid member is further adapted to induce a significant flexural moment adjacent said first and second top ends in response to the catastrophic shear forces.

4. The method of claim 1 wherein said rigid beam is rectangularly-shaped.

5. The method of claim 1 wherein said rigid member is a wall made form poured concrete and reinforcing steel.

6. The method of claim 1 further comprising inducing a plurality of plastic hinges in said first and second series of stacked shear walls in said second positions.

7. The method of claim 6 wherein said plurality of plastic hinges includes at least two plastic hinges having opposite directions.

8. The method of claim 1 wherein:

said first series of stacked shear walls comprises poured-in-place concrete tunnels, each tunnel having a first longitudinal axis;

said second series of stacked shear walls comprises poured-in-place concrete tunnels adjacent and spaced apart from said first series, each tunnel having a second longitudinal axis;

and wherein said first longitudinal axis is parallel to said second longitudinal axis.

9. The method of claim 8 wherein said first longitudinal axis is perpendicular to said second longitudinal axis.

10. The method of claim 1 further comprising:

a corridor separating said first and second series of stacked shear walls; and wherein said connected series of stacked shear walls are parallel, and said rigid member is parallel to said connected series of stacked shear walls.

11. The method of claim 1 further comprising:

creating a first flexural moment adjacent each of said bottom ends after said moving step; and creating a second flexural moment adjacent each of said top ends after said moving step.

12. The method of claim 11 wherein said flexural moments are approximately equal and act in opposite directions.

* * * * *

UNITED STATES PATENT AND TRADEMARK OFFICE

CERTIFICATE OF CORRECTION

PATENT NO. : 7,596,922 B2
APPLICATION NO. : 10/685048
DATED : October 6, 2009
INVENTOR(S) : Englekirk et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 874 days.

Signed and Sealed this

Twenty-eighth Day of September, 2010

David J. Kappos

David J. Kappos
*Director of the United States Patent and Trademark Office*